United States Patent [19]

Abraham

[11] Patent Number: 4,838,992

[45] Date of Patent: Jun. 13, 1989

[54] METHOD OF ETCHING ALUMINUM ALLOYS IN SEMI-CONDUCTOR WAFERS

[75] Inventor: Thomas Abraham, Kanata, Canada

[73] Assignee: Northern Telecom Limited, Montreal, Canada

[21] Appl. No.: 54,867

[22] Filed: May 27, 1987

[51] Int. Cl.[4] ..... C03C 15/00

[52] U.S. Cl. ..... 156/643; 156/641; 156/646; 156/665; 252/79.3; 204/192.35

[58] Field of Search ..... 156/643, 665, 641, 646; 252/793; 204/192.35

[56] References Cited

U.S. PATENT DOCUMENTS

| | | | |
|---|---|---|---|
| 4,182,646 | 1/1980 | Zajac | 156/665 |
| 4,341,593 | 7/1982 | Kurisaki et al. | 156/665 |
| 4,412,885 | 11/1983 | Wang et al. | 156/643 |
| 4,468,284 | 8/1984 | Nelson | 156/643 |
| 4,479,850 | 10/1984 | Beinvogl et al. | 156/643 |
| 4,505,782 | 3/1985 | Jacob et al. | 156/643 |
| 4,529,475 | 7/1985 | Okano et al. | 209/192.34 |
| 4,597,826 | 7/1986 | Majima et al. | 156/643 |
| 4,618,398 | 10/1986 | Nawata et al. | 156/643 |

OTHER PUBLICATIONS

Japanese Patent Abs., vol. 11, No. 150, #C422, 2/15/87, (284585).
Japanese Patent Abs., vol. 9, No. 302, #E362, 11/29/85, (140845).
Japanese Patent Abs. vol. 9 No. 147 #E323 6/21/85 (20248).
Japanese Patent Abs., vol. 8, No. 123, #E249, 6/8/84, (34634).
Japanese Patent Abs., vol. 8, No. 70, #E235, 4/3/84, (220447).
Japanese Patent Abs., vol. 8, No. 70, #E235, 4/3/84, (220420).
Japanese Patent Abs., vol. 7, No. 210, #E200, 9/28/83, (108755).
Japanese Patent Abs., vol. 6, No. 87, #E108, 5/25/82, (20450).
Japanese Patent Abs., vol. 5, No. 95, #E062, (40258).
Japanese Patent Abs., vol. 5, No. 44, #E050, (1538).
Y. Hazuke, et al., VLSI Symposium Digest of Technical Papers, p. 18, Sep. 1982.
G. Gimpelson and C. Russo, Proceedings First International Conference IEEE, V-MIC, p. 27, Jun. 1984.
J. Mercier, et al., Journal of ECS, vol. 132, No. 5, p. 1219, May 1985.
M. Khan, Y. Strunk and S. Huang, Proceedings Second International IEEE V-MIC, p. 32, Jun. 1985.
W. Yao, et al., Proceedings Second International IEEE V-MIC, p. 38, Jun. 1985.
T. Abraham, Proceedings Third International Conference IEEE V-MIC, p. 198, Jun. 1986.
B. Chapman, "Glow Discharge Processes", J. Wiley & Sons, p. 247, 1980.
E. J. McInerney, Proceedings Third International Conference IEEE V-MIC, p. 467, Jun. 1986.
H. Kotani, et al., J. ECS, p. 645, Mar. 1983.
K.O. Park, Proceedings 4th International Symposium on Plasma Processing, p. 300, 1983.

(List continued on next page.)

*Primary Examiner*—Kenneth M. Schor
*Assistant Examiner*—L. Johnson
*Attorney, Agent, or Firm*—Cushman, Darby & Cushman

[57] ABSTRACT

A plasma etching technique for producing tapered side walls on the desired Aluminum conductor pattern is described. This involves forming a resist pattern on the Aluminum layer of a wafer and carrying out a first etching step using $Cl_2$, $BCl_3$ and $CF_4$ at predetermined flow rates and low pressure until all the exposed Aluminum is removed. At the end of this step the Aluminum side walls are virtually vertical and facets are present on the resist. A second etching step is carried out under essentially the same conditions as before except that the $Cl_2$ is reduced. During this etching step the facets on the resist are propagated laterally while the Aluminum side walls become tapered. According to modifications a rounded or jogged configuration can be obtained on the side walls but these too are considered generally tapered in nature as they progress from a wider base to a narrower peak.

26 Claims, 2 Drawing Sheets

OTHER PUBLICATIONS

J. E. Spencer, Proceedings 4th International Symposium on Plasma Processing, p. 321, 1983.

E. R. Sirkin and E. Crable, Proceedings 4th International Symposium on Plasma Processing, p. 467, 1983.

The Equilibrium Topography of Sputtered Amorphous Solids III. Computer Simulation. Cristina Catana, J. S. Colligon, G. Carter, Journal of Materials Science, 7, (1972), pp. 467–471.

Sputtering at Acute Incidence, K. B. Cheney and E. T. Pitkin, Journal of Applied Physics, vol. 36, No. 11, Nov. 1965, pp. 3542–3544.

The Dependence of Sputtering Efficiency on Ion Energy and Angle of Incidence, H. H. Andersen, Radiation Effects, 1971, vol. 7, pp. 179–186.

Influence of the Angle of Incidence on Sputtering Yields, G. Wehner, Journal of Applied Physics, vol. 10, No. 11, Nov. 1959, pp. 1762–1765.

A New Production Technique: Ion Milling, D. Bollinger; R. Fink, Solid State Technology, Nov. 1980, pp. 79–84.

D. J. Oostra, A. Haring & A. E. de Vries; J. Vac. Sci. Technol. B4 (6) Nov./Dec. 1986, pp. 1278–1282.

Time-of-Flight and Surface Residence Time Measurements for Ion-Enhanced Si-$Cl_2$ Reaction Products, R. A. Rossen and H. H. Sawin; J. Vac. Sci. Technol. A5(4), Jul./Aug., 1987, pp. 1595–1599.

Anomalous Time-of-Flight Distribution Observed for Argon Implanted in Silicon and Resputtered by $Ar^+$-Ion Bombardment, G. N. A. van Veen, F. H. M. Sanders and J. Dieleman, Physical Review Letters, vol. 57, No. 6, 11 Aug., 1986, pp. 739–742.

Chemical Sputtering by keV Ions, R. A. Haring, A. W. Kolfschoten and A. E. de Vries, Nuclear Instruments and Methods in Physics Research B2, (1984), pp. 544–549, North-Holland, Amsterdam.

Argon-ion Assisted Etching of Silicon by Molecular Chlorine. A. W. Kolfschoten, R. A. Haring; A. Haring and A. E. de Vries, J. Appl. Phys. 55(10), May 15, 1984, pp. 3813–3818.

Sloped Vias in Polyimides by RIE; C. H. Ting, S. Yeh, K. L. Liauw, Semiconductor International, Feb. 1985, pp. 82–85.

Sidewall Tapering in Reactive Ion Etching, A. G. Nagy, (Name of publication unknown).

Ion-Beam Etching of Surface Gratings, H. I. Smith, J. Melngailis, R. C. Williamson, W. T. Brogan, (Name of publication unknown).

Reactive Sputter Etching of Al in $BCl_3$, H. W. Lehmann and R. Widmer, Microelectronic Engineering 1, (1983), 3–27, North-Holland.

Aluminum Taper Etching Using Resist (-Si) Al Structure, H. Hoga, M. Kanaya, S. Sugama, (OKI Electric) SPIE Conference, Abstract, 633–724.

METHOD OF ETCHING ALUMINUM ALLOYS IN SEMI-CONDUCTOR WAFERS

BACKGROUND OF THE INVENTION

This invention relates generally to the plasma etching of metal conductors, particularly Aluminum, in the fabrication of semiconductor integrated circuits.

Typically such circuits are formed by depositing an Aluminum layer on top of a silicon dioxide layer. A photoresist layer is then applied over the Aluminum layer and photographically exposed to the desired conductor pattern after which portions of the photoresist are removed leaving the desired pattern on the photoresist layer. Thereafter, using a plasma etching technique the exposed portions of the Aluminum layers are removed leaving the desired conductor pattern of Aluminum on the silicon dioxide layer. The remaining resist is then removed and, in the case of multi-level circuits, another silicon dioxide layer is applied, this layer covering the Aluminum conductors and the spaces between the conductors. Thereafter, the process described above is repeated for the second level.

A problem that has been encountered in the manufacture of multi-level circuits is that of ensuring that the silicon dioxide layer deposited on the Aluminum conductor pattern is complete and free of discontinuities or voids or weaknesses, particularly at locations between the conductors. This problem has become more severe as the spacing between the conductors has become smaller.

This problem has been recognized and discussed in the literature, and Messrs. Arikado, Sekine, Okano and Horiike in an IEEE article entitled "Al Tapered Etching Application to Submicron Multilevel Interconnection Process" and published in December 1986 suggest the tapering of the Aluminum side walls to mitigate this problem. The process suggested involves etching using a mixture of $CHCl_3$ and $Cl_2$. A polymerized film is continuously deposited on the resist sidewalls during the process and this gives rise to the tapering. One problem associated with this technique is the difficulty in controlling the polymer deposition and hence the final profile.

U.S. Pat. No. 4,412,885 also discloses an etching technique for providing tapered Aluminum side walls in which a principal gas mixture of $BCl_3$ and $Cl_2$ is supplemented by a dopant gas mixture of $O_2$ and a fluorocarbon gas, preferably $CF_4$. What is not brought out in the above-identified patent is that the angle of taper of the Aluminum side walls is a function of the angle of taper of the side walls of the overlying resist. Accordingly, to control accurately the slope of the Aluminum side walls it is necessary to control the initial slope of the resist walls.

In general, it is difficult to control the resist slope and particularly when the Aluminum conductor lines (and consequently the resist lines thereon) are of the order of 2 μm or less resist slope becomes virtually impossible to control.

SUMMARY OF THE INVENTION

It is an object of the present invention to overcome the problems associated with the prior art by using a novel etching technique based on reactive facet tapering of the resist.

According to the invention, etching is carried out in at least two separate consecutive steps. The first step is the principal etching step which leaves the side walls of the aluminum virtually vertical. The second step achieves the desired degree of tapering.

The invention may be summarized, according to a first broad aspect, as a method of etching a layer of electrically conductive material, having aluminum as the principal element, formed on a semiconductor wafer, comprising forming a resist pattern on the layer of electrically conductive material, subjecting the wafer to a first plasma etching step using a gas mixture containing at least $Cl_2$, together with $SiCl_4$ or preferably $BCl_3$, at predetermined flow rates and operating at low pressure until all the exposed electrically conductive material is removed whereby virtually vertical side walls of the electrically conductive material are obtained, and subjecting the wafer to a second plasma etching step using essentially the same components in the gas mixture and same pressure but with the flow rate of the $Cl_2$ reduced whereby tapering of the side walls is achieved by lateral facet propagation of the resist using the Chlorine species. It should be apparent to one of ordinary skill in the art that in etching processes involving a plurality of separate etching steps, the etching apparatus is de-energized and evacuated between etching steps. Accordingly, such procedure will not be described explicitly hereinafter but is to be understood.

Improved results are obtained when the resist has a rounded profile and it is advantageous, therefore to subject the wafer to pre-etching steps, such as heating to achieve this rounded profile.

Modifications of the basic technique can be used to obtain stepped (or jogged) side walls or curved side walls which also generally exhibit the tapering necessary to achieve better step coverage in a multi-level structure.

The jogged side walls are obtained in a method of etching a layer of electrically conductive material, having aluminum as the principal element, formed on a semiconductor wafer, comprising forming a resist pattern on the layer of electrically conductive material, subjecting the wafer to a first plasma etching step using a gas mixture containing at least $Cl_2$, together with $SiCl_4$ or preferably $BCl_3$, at predetermined flow rates and operating at low pressure until the exposed electrically conductive material begins to be removed, subjecting the wafer to a second plasma etching step using essentially the same components in the gas mixture but with a higher flow rate of $Cl_2$, and preferably also a higher flow rate of the $BCl_3$ or $SiCl_4$, and higher pressure until all of the exposed electrically conductive material is removed, and subjecting the wafer to a third plasma etching step using essentially the same components of the gas mixture and pressure as in the first etching step but a lower flow rate of $Cl_2$, whereby jogged side walls of the electrically conductive material are obtained.

DESCRIPTION OF THE DRAWINGS

The invention will now be described in greater detail with reference to the accompanying drawings, in which.

DESCRIPTION OF THE PREFERRED EMBODIMENTS

Figure 1:
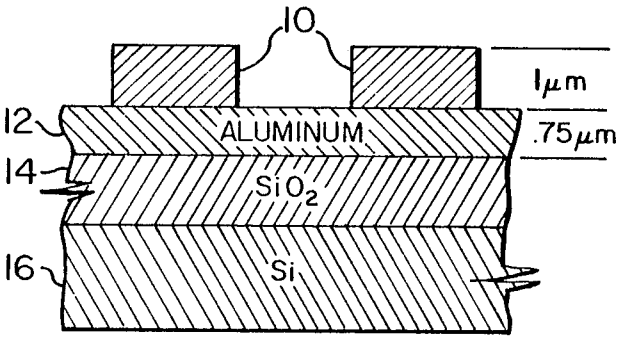
FIGS. 1–4 illustrate successive steps in an etching process according to one aspect of the invention.
Figure 2:
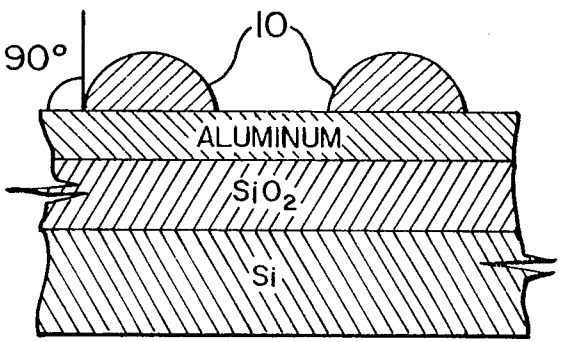

With reference to FIG. 1, using any conventional technique, a photoresist pattern 10 is provided on an Aluminum layer 12 provided on a $SiO_2$ layer 14 laid over a Si substrate 16. The photoresist material may, for example, be Xanthachrome, HPRD118, AZ1470 or McDermid PR914. The wafer is then heated to a suitable temperature, using a hot plate bake for example, to cause partial melting and rounding of the resist. If necessary, the wafer may then be transferred to a MICROLITE 126 C system to cause U.V. hardening of the resist. The profile of the resist pattern 10 of this stage is as shown in FIG. 2.

The wafer is then transferred to an AME8135 plasma etcher, to etch the Aluminum using a mixture of $BCl_3$, $Cl_2$ and $CF_4$ under the following conditions

| | |
|---|---|
| D.C. bias | −300 V |
| Pressure | 15 mtorr |
| $BCl_3$ | 60 sccm |
| $Cl_2$ | 12 sccm |
| $CF_4$ | 10 sccm |

Other low pressure reactive ion etchers could be used instead of the AME8135 system. For example, an AME8130, an AME8330 or an MRC Aries magnetron system could be used. The specific values of bias voltage, pressure and flow rates chosen would be dependent on the specific system used. The following list is believed to cover generally the ranges of values which would be used.

| | |
|---|---|
| D.C. bias | −260 V to −350 V |
| Pressure | 5 mtorr to 20 mtorr |
| $BCl_3$ | 50 to 70 sccm |
| $Cl_2$ | 8 to 12 sccm |
| $CF_4$ | 0 to 15 sccm (preferably 5–15) |

It will be noted from the above table that the $CF_4$ may be eliminated but it is preferred to include $CF_4$. Also it might be possible to use $SiCl_4$ instead of $BCl_3$ although this has not been verified experimentally yet. What is important is that there is sufficient Chlorine available for the resist facetting.

Figure 3:
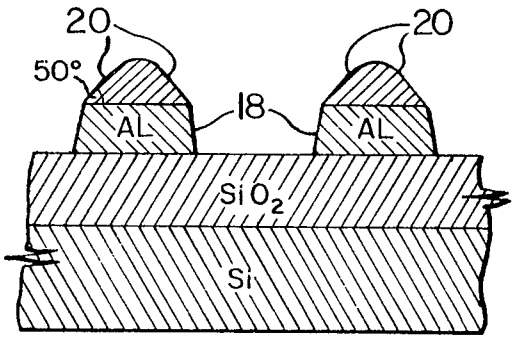

Etching is continued until all the Aluminum between the resist lands has been removed. During this time a facet is formed on the sides of the resist features. The wafer is now in the condition shown in FIG. 3. In this condition the side walls 18 of the Aluminum are virtually vertical, with an angle of perhaps 85°. The resist pattern 10 has been facetted by the etching process and the facets are references 20. Although these are shown as single facets in practice each facet 20 may be a multiple facet having increased angles nearer the top of the resist.

Figure 4:
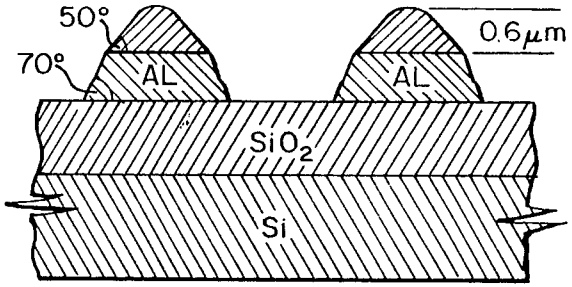

Etching is restarted but the flowrate of the $Cl_2$ is reduced from 12 sccm to 3 sccm, all other conditions being as per the previous etching step. (Using a different etching system, such one of those referred to above, the same extent of reduction in $Cl_2$ flowrate might differ but with any system the flowrate of the $Cl_2$ is reduced as compared to the previous etching step.) During this etching step the facets on the resist are propagated laterally while the Aluminum side walls 18 are tapered. Etching is continued for a time approximately 20% as long as the duration of the first etching step until the condition shown in FIG. 4 is reached. Here the Aluminum side walls 18 have a taper of approximately 70° while the resist facets 20 are now at 50°. It is noted that the height of the resist has been reduced from about 1 μm at the start of the second etching step to about 0.6 μm at the end.

The theoretical basis of the second etching step is believed to be as follows. The absence of exposed Aluminum at the beginning of the second etching step results in a higher concentration of Chlorine etch species for the lateral eroding of the resist using facet propagation. Initially, while the resist facet is being moved laterally the Aluminum is not etched because of the presence of native oxide on the Aluminum top surface. After a minute or so the native oxide will be etched through and the Chlorine will start etching the Aluminum vertically. If etching is discontinued after a short time a jog will appear in the side wall. If the etching is continued for a longer time the jog moves down the side wall and is substantially smoothed or eliminated. It should be noted that, as soon as the native oxide is etched through, there is now competition between the resist and the Aluminum for the Chlorine etch species. It is the ratio of Chlorine etching the resist to Chlorine etching the Aluminum that gives the slope.

Figure 5:
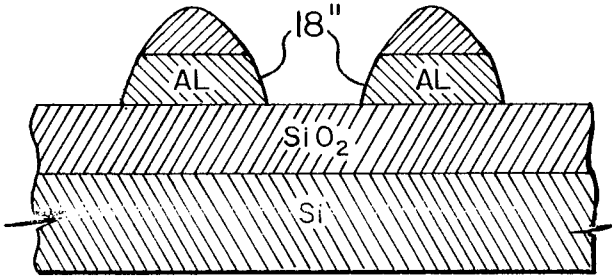
FIG. 5 illustrates the end of the final etching step according to a modification of the basic technique shown in FIGS. 1–4.

FIG. 5 shows a modification of the inventive process described with reference to FIGS. 1–4 in which the only difference is that the $Cl_2$ is further reduced or eliminated from the second etching step. The $BCl_3$ alone provides the Chlorine species for etching and the effect of decreased concentration of Chlorine is that the jog mentioned above is smoothed and the Aluminum walls 18'' end up with a curved or rounded configuration as shown.

The wafer is now passivated using a standard process for 10 minutes. More particularly, this involves a fluorine plasma, $CF_4$, $CHF_3$ or $SF_6$ to remove adsorbed Chlorine species on the side wall and replace it with fluorine species. This prevents corrosion of the metal when it is exposed to the atmosphere.

Figure 6:
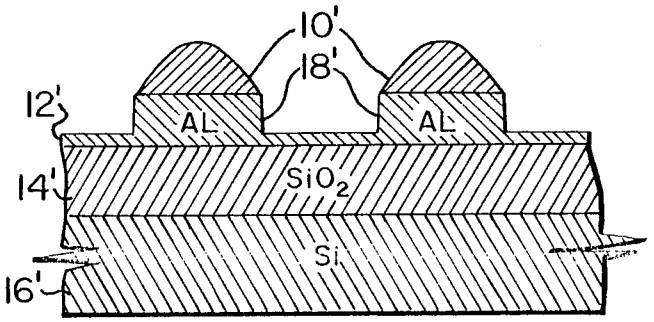
FIGS. 6–8 illustrate successive steps in another modified process according to the invention.
Figure 8:
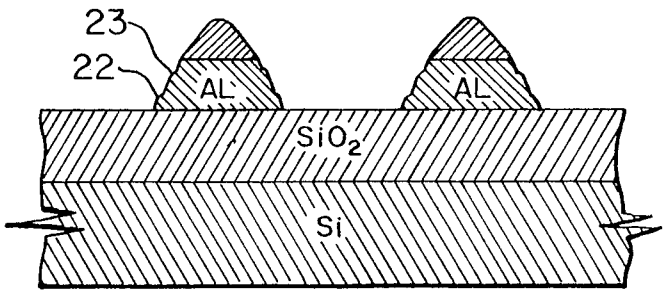
Figure 7:
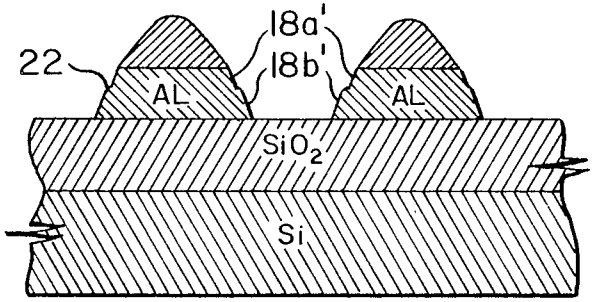

Referring now to FIGS. 6–8, these illustrate a modified etching process according to the invention in which the Aluminum walls end up with a stepped configuration. As with the first described process a rounded pattern of resist 10' is obtained by exposing, partial melting and hardening steps. Prior to the first etching step the wafer appears as in FIG. 2.

The wafer is transferred to the etcher and a first etching step carried out. The following conditions subsist in the etcher:

| | |
|---|---|
| D.C. bias | −300 V |
| Pressure | 15 mtorr |
| $BCl_3$ | 60 sccm |
| $Cl_2$ | 10 sccm |
| $CF_4$ | 10 sccm |

Etching is continued until the onset of clearing of the Aluminum as indicated in FIG. 6. It can be seen that vertical wall portions 18' have just begun in the Aluminum.

The second etching step is then begun using higher values of pressure and flow rates of $BCl_3$ and $Cl_2$, specifically 40 mtorr, 90 sccm, 20 sccm respectively with the remaining parameters being unchanged.

This causes a rapid lateral erosion of the facetted resist and subsequently, with increasing concentration of the Chlorine etch species as the exposed Aluminum begins to clear, enhanced etching occurs at the side wall in a vertical direction causing a jog 22 to form in the side wall 18'. This second step is continued until all the Aluminum is cleared as shown in FIG. 7. In the specific embodiment described herein the flow rates of both the $BCl_3$ and $Cl_2$ are increased for the second step but it is envisaged that the process would also be feasible if only the $Cl_2$ were increased. Furthermore, as with the embodiment described with reference to FIGS. 1–4, for the entire process, the $BCl_3$ could be replaced with $SiCl_4$ and the $CF_4$ eliminated.

A final etch step is initiated using a lower $Cl_2$ flow rate than in the first step, approximately 3 sccm , and other conditions similar to the first step. This is continued for a predetermined time resulting in the configuration shown in FIG. 8 which has an additional jog 23, the derivation of which is explained above in relation to the first etching process of FIGS. 1–4. In this case jog 23 remains because the etching time is kept short.

In the three processes described above, the resist is rounded as shown in FIG. 2. Rounding brings the resist facet closer to the Aluminum surface and so the facet arrives at the interface sooner than would be the case with a rectangular resist profile. The basic inventive technique will work without rounding of the resist but would require a longer taper step.

I claim:

1. A method of etching a layer of electrically conductive material, having aluminum as the principal element, formed on a semiconductor wafer, comprising forming a resist pattern on a layer of electrically conductive material having aluminum as the principle element, subjecting the wafer to a first plasma etching step using a gas mixture consisting essentially of $BCl_3$ and $Cl_2$ at predetermined flow rates and operating at low pressure until all the exposed electrically conductive material is removed whereby virtually vertical side walls of the electrically conductive material are obtained, and subjecting the wafer to a second plasma etching step using essentially the same components in the gas mixture and the same pressure and with the same flow rate of $BCl_3$ but with the flow rate of the $Cl_2$ reduced whereby tapering of the side walls is achieved, by lateral facet propagation of the resist using the chlorine species.

2. A method according to claim 1 in which, prior to the first etching step, the wafer is heated sufficiently to cause rounding of the resist.

3. A method according to claim 1 or claim 2 in which the $Cl_2$ is eliminated from the second etching step, thereby forming curved side walls.

4. A method according to claim 1 or claim 2 in which the electrically conductive material is essentially pure aluminum.

5. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $BCl_3$ and $Cl_2$ at predetermined flow rates and operating at low pressure until the exposed electrically conductive material begins to be removed, subjecting the wafer to a second plasma etching step using essentially the same components in the gas mixture but with higher flow rates of $BCl_3$ and $Cl_2$ and higher pressure until all of the exposed electrically conductive material is removed, and subjecting the wafer to a third plasma etching step using essentially the same components of the gas mixture and pressure and the same flow rate of $BCl_3$ as in the first etching step but a lower flow rate of $Cl_2$, whereby jogged side walls of the electrically conductive material are obtained.

6. A method according to claim 5 in which, prior to the first etching step, the wafer is heated sufficiently to cause rounding of the resist.

7. A method according to claim 5 or 6 in which the electrically conductive material is essentially pure aluminum.

8. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $SiCl_4$ and $Cl_2$ at predetermined flow rates and operating at low pressure until all the exposed electrically conductive material is removed whereby virtually vertical side walls of the electrically conductive material are obtained, and subjecting the wafer to a second plasma etching step using essentially the same components in the gas mixture and same pressure and with the same flow rate of $SiCl_4$ but with the flow rate of the $Cl_2$ reduced whereby tapering of the side walls is achieved, by lateral facet propagation of the resist using the chlorine species.

9. A method according to claim 8 in which, prior to the first etching step, the wafer is heated sufficiently to cause rounding of the resist.

10. A method according to claim 8 or claim 9 in which the $Cl_2$ is eliminated from the second etching step, thereby forming curved side walls.

11. A method according to claim 8 or claim 9 in which the electrically conductive material is essentially pure aluminum.

12. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $SiCl_4$ and $Cl_2$ at predetermined flow rates and operating at low pressure until the exposed electrically conductive material begins to be removed, subjecting the wafer to a second plasma etching step using essentially the same components in the gas mixture but with higher flow rates of $SiCl_4$ and $Cl_2$ and higher pressure until all of the exposed electrically conductive material is removed, and subjecting the wafer to a third plasma etching step using essentially the same components of the gas mixture and pressure and the same flow rate of $SiCl_4$ as in the first etching step but a lower flow rate of $Cl_2$, whereby jogged side walls of the electrically conductive material are obtained.

13. A method according to claim 12 in which, prior to the first etching step, the wafer is heated sufficiently to cause rounding of the resist.

14. A method according to claim 12 or 13 in which the electrically conductive material is essentially pure aluminum.

15. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $BCl_3$ and $Cl_2$ and $CF_4$ at predetermined flow rates and operating at low pressure until all the exposed electrically conductive material is removed whereby virtually vertical side walls of the electrically conductive material are obtained, and subjecting the wafer to a second plasma etching step using essentially the same components in the gas mixture and the same pressure and with the same flow rates of $BCl_3$ and $CF_4$ but with the flow rate of the $Cl_2$ reduced whereby tapering of the side walls is achieved, by lateral facet propagation of the resist using the Chlorine species.

16. A method according to claim 15 in which, prior to the first etching step, the wafer is heated sufficiently to cause rounding of the resist.

17. A method according to claim 15 or claim 16 in which the $Cl_2$ is eliminated from the second etching step, thereby forming curved side walls.

18. A method according to claim 15 or claim 16 in which the electrically conductive material is essentially pure aluminum.

19. A method according to claim 1, 8 or 15 in which the low pressure is no greater than 20 mtorr.

20. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $BCl_3$ and $Cl_2$ and $CF_4$ at predetermined flow rates and operating at low pressure until the exposed electrically conductive material begins to be removed, subjecting the wafer to a second plasma etching step using essentially the same components in the gas mixture and the same flow rate of $CF_4$ but with higher flow rates of $BCl_3$ and $Cl_2$ and higher pressure until all of the exposed electrically conductive material is removed, and subjecting the wafer to a third plasma etching step using essentially the same components of the gas mixture and pressure and the same flow rates of $BCl_3$ and $CF_4$ as in the first etching step but a lower flow rate of $Cl_2$, whereby jogged side walls of the electrically conductive material are obtained.

21. A method according to claim 20 in which, prior to the first etching step, the wafer is heated sufficiently to cause rounding of the resist.

22. A method according to claim 20 or 21 in which the electrically conductive material is essentially pure aluminum.

23. A method according to claim 5, 12 or 20 in which the low pressure in the first etching step is no greater than 20 mtorr.

24. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $BCl_3$ and $Cl_2$ at predetermined flow rates and operating at low pressure until the exposed electrically conductive material begins to be removed, subjecting the wafer to a second plasma etching step using essentially the same components in the gas mixture and the same flow rate of $BCl_3$ but with a higher flow rate of $Cl_2$ and higher pressure until all of the exposed electrically conductive material is removed, and subjecting the wafer to a third plasma etching step using essentially the same components of the gas mixture and pressure and the same flow rate of $BCl_3$ as in the first etching step but a lower flat rate of $Cl_2$, whereby jogged side walls of the electrically conductive material are obtained.

25. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $SiCl_4$ and $Cl_2$ at predetermined flow rates and operating at low pressure until the exposed electrically conductive material begins to be removed, subjecting the wafer to a second plasma etching step using essentially the same components in the gas mixture and with the same flow rate of $SiCl_4$ but with a higher flow rate of $Cl_2$ and higher pressure until all of the exposed electrically conductive material is removed, and subjecting the wafer to a third plasma etching step using essentially the same components of the gas mixture and pressure and the same flow rate of $SiCl_4$ as in the first etching step but a lower flow rate of $Cl_2$, whereby jogged side walls of the electrically conductive material are obtained.

26. A method of etching a layer of electrically conductive material, having aluminum as the principal element, formed on a semiconductor wafer, comprising forming a resist pattern on a layer of electrically conductive material having aluminum as the principal element, subjecting the wafer to a first plasma etching step using a gas mixture consisting essentially of $BCl_3$, $Cl_2$ and $CF_4$ at predetermined flow rates and operating at low pressure until the exposed electrically conductive material begins to be removed, subjecting the wafer to a second plasma etching step using essentially the same components in the gas mixture and the same flow rates of $BCl_3$ and $CF_4$ but with a higher flow rate of $Cl_2$ and higher pressure until all of the exposed electrically conductive material is removed, the subjecting the wafer to a third plasma etching step using essentially the same components of the gas mixture and pressure and the same flow rates of $BCl_3$ and $CF_4$ as in the first etching step but a lower flow rate of $Cl_2$ whereby jogging side walls of the electrically conductive material are obtained.

* * * * *